US005870923A

United States Patent [19]

Eisen et al.

[11] Patent Number: 5,870,923

[45] Date of Patent: Feb. 16, 1999

[54] FORGING METHOD

[75] Inventors: Manfred Eisen, Munich; Werner Spielmann, Haar; Georg Tauschek, Munich, all of Germany

[73] Assignee: BLW Prazisionsschmiede GmbH, Munich, Germany

[21] Appl. No.: 712,956

[22] Filed: Sep. 12, 1996

Related U.S. Application Data

[63] Continuation of Ser. No. 279,267, Nov. 29, 1988, abandoned, which is a continuation of Ser. No. 414,670, Sep. 3, 1982, abandoned.

[30] Foreign Application Priority Data

Sep. 3, 1981 [DE] Germany ..... 3134857

[51] Int. Cl.[6] ..... B21J 5/12

[52] U.S. Cl. ..... 72/377

[58] Field of Search ..... 72/356, 374, 376, 72/377, 412; 29/893.34; 192/114 T

[56] References Cited

U.S. PATENT DOCUMENTS

| | | | |
|---|---|---|---|
| 600,994 | 3/1898 | See | 29/893.34 |
| 822,983 | 6/1906 | Rhoda | 29/521 |
| 874,448 | 12/1907 | Smith | 29/159.2 |
| 925,028 | 6/1909 | Richards | 72/377 |
| 1,543,608 | 6/1925 | Leidecker | 72/412 |
| 1,597,198 | 8/1926 | Howell | 192/114 T |
| 1,866,315 | 7/1932 | Merrill | 72/412 |
| 2,843,927 | 7/1958 | Stock | 29/545 |
| 3,455,138 | 7/1969 | Zapf | 72/352 |
| 3,498,100 | 3/1970 | Gudish et al. | 72/356 |
| 3,739,664 | 6/1973 | Swanstrom | 81/414 |
| 3,780,840 | 12/1973 | Thomas | 192/114 T |
| 3,987,539 | 10/1976 | Gravener | 72/370 |
| 4,216,575 | 8/1980 | Carnavos et al. | 72/370 |
| 4,362,043 | 12/1982 | Hanson | 72/356 |

FOREIGN PATENT DOCUMENTS

| | | | |
|---|---|---|---|
| A1 2448473 | of 0000 | Germany . | |
| A1 2502306 | of 0000 | Germany . | |
| A1 2655205 | of 0000 | Germany . | |
| 356 109 | 2/1920 | Germany . | |
| 356109 | 7/1922 | Germany | 29/159.1 |
| 2855712 | 4/1980 | Germany | B21K 1/70 |
| 26538 | of 1914 | United Kingdom | 29/159.1 |
| 1039905 | 8/1966 | United Kingdom . | |
| 1 542 981 | 3/1979 | United Kingdom . | |
| 2 106 435 | 8/1985 | United Kingdom . | |

OTHER PUBLICATIONS

VDI Bericht Nr. 47, 1961; pp. 33–38.

*Primary Examiner*—Lowell A. Larson
*Attorney, Agent, or Firm*—Helfgott & Karas, P C.

[57] ABSTRACT

For producing coupling members with a negative relief of the load-bearing contact surfaces, according to a method for the precision forging of coupling members, it is proposed that in a rough-forging process, first of all contact surfaces (5) parallel to the direction of the forging stroke are produced and in particular with an admeasurement exceeding the adjoining top faces (2) at least in the marginal region adjoining the respective common edge (3) of the spacers and that in a subsequent cold gauging process, the top faces are forged with exact measurements so that every finished contact surface extends obliquely towards the top face enlarged by gauging.

8 Claims, 2 Drawing Sheets

FORGING METHOD

This is continuation of application Ser. No. 07/279,267, filed Nov. 29, 1988, now abandoned which is a continuation of application Ser. No. 414,670 filed on Sep. 3, 1982.

The invention relates to a method for the precision forging of forgings with at least one contact surface serving for the transmission of power in cooperation with a counterpart, in particular of coupling members comprising claws or pockets or of synchronous parts comprising short toothing for gear-shift mechanisms, in which the members are firstly rough-forged and then cold-gauged.

Furthermore, the invention relates to workpieces produced according to the aforementioned method, namely coupling members for claw couplings, synchronous coupling members for gear-shift mechanisms or the like, coupling members comprising short toothing or claws or pockets, also ratchet wheels, drive shafts etc.

Since, in coupling members of the said type, there is a danger that during operation they become detached from their respective counterpart, which under certain circumstances may lead to considerable damage to the gears, at least to undesirable operating uncertainty, there has been a change towards constructing the coupling claws or teeth with short toothing, with sides having a back taper. This means that the surfaces effecting the coupling and transmitting the loads or torque, which are referred to hereafter as contact surfaces and in the case of toothing correspond to the tooth sides, have a back taper of approximately 1° to 3° in the direction of the coupling movement, i.e. with respect to a claw or tooth on a coupling member, that the claw or tooth narrows down from the top in the direction of the base. If the counterpart of the coupling member has the same back taper, this produces a coupling engagement, in which any disengagement under load is prevented.

It is also required of a coupling engagement of this type, that the bearing portion of the relieved surface amounts to more than 50%. In this way, a sufficiently long working life should be ensured for the coupling members.

The forging of coupling members with relieved contact surfaces is not possible in practice, since a division of the forging die tolerating the relief cannot be achieved either economically or technically. In a known forging method (British Patent specification 10 39 905) for producing a bevelled gear, after forging of the gear, by means of cold-gauging in a gauging die, a correction of the shape of the sides of the teeth is produced for varying the surface appearance. This gives rise to a transfer of material from the edges to the centre of the tooth sides, which transfer is restricted to a thin surface layer, without back tapers being produced in so doing.

Another known method (U.S. Pat. No. 2,843,927) relates to the manufacture of toothed racks, with a negative relief of the tooth sides between 14.5° and 20°. The toothing is thus formed by cross-pieces remaining between a row of punched holes in a basic member. The punching operation in this case brings about an inclined relief of the sides of these cross-pieces, which receive their finished surface due to subsequent cold-gauging from the rear side.

Finally, the manufacture of forgings is known (U.S. Pat. No. 3,739,664), which comprise a row of projections, in which case the gaps between the projections on the one hand has a negative and on the other hand a positive inclination of the sides. Since all the sides of a workpiece of this type are aligned in the same way, the workpiece can be removed from the die after forging.

In contrast thereto, it is the object of the present invention to provide a method of the aforementioned type, such that with this method workpieces, in particular coupling members, with a negative back taper of the contact surface transmitting the load can be produced.

This object is achieved according to the invention due to the fact that during rough-forging contact surfaces parallel to the beating direction with the admeasurement exceeding the adjacent top faces are produced at least in the marginal region adjoining the respective common edge of these faces and that during cold-gauging, the top faces are forged with exact measurements so that each finished contact surface extends obliquely towards the top face enlarged by gauging.

According to this method it is possible to produce the back tapers of the contact surfaces accurately up to approximately 5°. With correct determination and distribution of the admeasurement, any bulging of the contact surfaces to form a spherical shape is avoided, in which case the gauging stroke takes place with free deformation of the contact surfaces, i.e. taking place without any support by means of the die, until an inclined position is reached providing the desired back taper. During the gauging stroke, the flow of material is firstly initiated in the marginal region due to the admeasurement, before the effect of the pressure is distributed over the entire top face. In this way, any convex deformation of the contact surfaces can be reliably prevented.

In the case of toothing on coupling members, whether the latter are claws or pockets or short toothing, the sides of a tooth or a claw forming the contact surfaces and located opposite each other respectively have a negative relief in the same manner so that the gaps between the teeth widen out towards the base of the tooth. Naturally it is also possible within the framework of the method according to the invention to produce individual contact surfaces with relief, in which case the opposed surface in the region of the back may be constructed to be straight, or even with a positive inclination.

To achieve a controlled relief of the contact surfaces, it is advantageous that during cold-gauging, the forgings are supported by the die solely between two die faces extending parallel to the beating direction and at right angles to the contact surfaces.

In order to keep symmetry faults in toothing small and thus at the same time to ensure that at least 75% of the teeth of a gear rim bear it may be advantageous that the enlargement of the top faces of the teeth is limited by support faces in the die arranged at a corresponding distance from the preform. In this case it is sufficient if the support faces are present solely in the radius described by the top faces.

The determination of the admeasurement is critical for the angle reached by the back taper, as well as the flat shape of the contact surface. For this purpose, it is proposed according to the invention that the admeasurement volume per contact surface is determined according to its selected back taper or inclined position with respect to the top face.

At the same time it is essential that the distribution of the admeasurement along a section extending at right angles to the contact surface is a maximum in or near the contact surface.

In order to control the edge pressure during cold-gauging and simultaneously the deformation pressure over the entire contact surface it is appropriate that the distribution of the admeasurement describes a course decreasing in a straight line or in a concave manner in the marginal region of the top face adjoining the contact surface.

The preferred use of the method according to the invention relates to claw couplings, in which case the sides of the claws or pockets of the two cooperating coupling members transmitting load correspond to the contact surfaces, in which case every side or every other side is relieved.

In the same manner, the method according to the invention can be applied to known short toothing with tapered teeth, in which case the back tapers produced hitherto by subsequent rolling or erosion, are produced by the method according to the invention. This is suitable not only for producing back tapers on claws or pockets but also on involute-teeth gears and in particular both external toothing as well as internal toothing.

Several embodiments of the invention are described hereafter with reference to the drawings.

Figure 1:
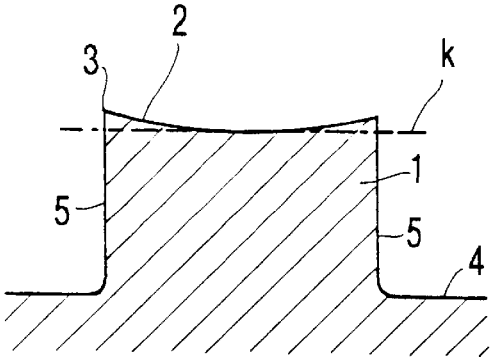
FIG. 1 is a section taken in the peripheral direction through a claw after rough-forging.

According to FIG. 1, after rough-forging, a claw 1 comprises a convex top face 2, the radial sides 3 of the claw 1 are at right angles to the bottom face 4 of the claw. A broken line k, which extends parallel to the bottom face 4 of the claw, represents the admeasurement of the top face 2 before cold-gauging.

Figure 2:
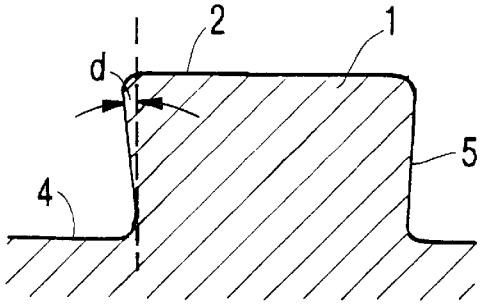
FIG. 2 is a section taken in the peripheral direction through the claw according to FIG. 1 after gauging.

FIG. 2 shows the claw illustrated in FIG. 1, after cold-gauging. The top face 2 extends parallel to the bottom face 4 of the claw. In the radial direction, the claw 1 is defined on both sides by relieved contact surfaces 5, in which case the angle defining the relief is designated by d.

Figure 3:
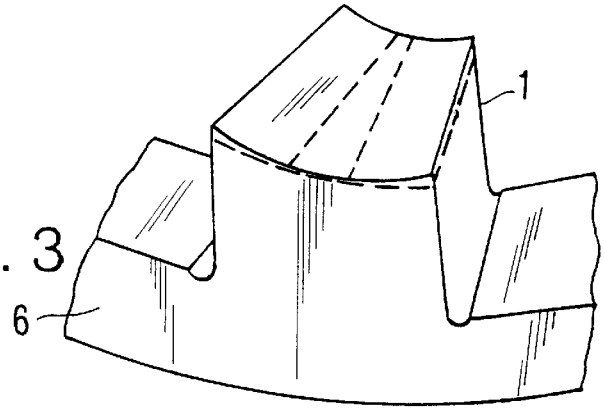
FIG. 3 is a perspective view of the claw according to FIG. 1.

FIG. 3 is a cut away view of a coupling member with claws 1, which project axially with respect to an annular part 6. The shape of the coupling member corresponds to its intermediate shape after rough forging, in which case the admeasurement of the top face is shown by broken lines.

Figure 4:
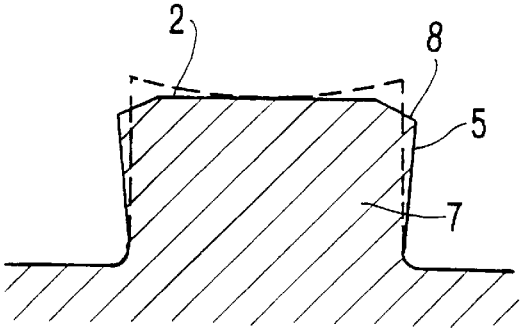
FIG. 4 is a section taken in the peripheral direction through a claw with slip-chamfer in the region of the edges formed between the top face and contact surface.

FIG. 4 is a section taken in the peripheral direction, through a claw 7, with lateral slip chamfers 8 between the top face 2 and contact surface 5, the preform produced by rough forging is shown in broken lines.

Figure 5:
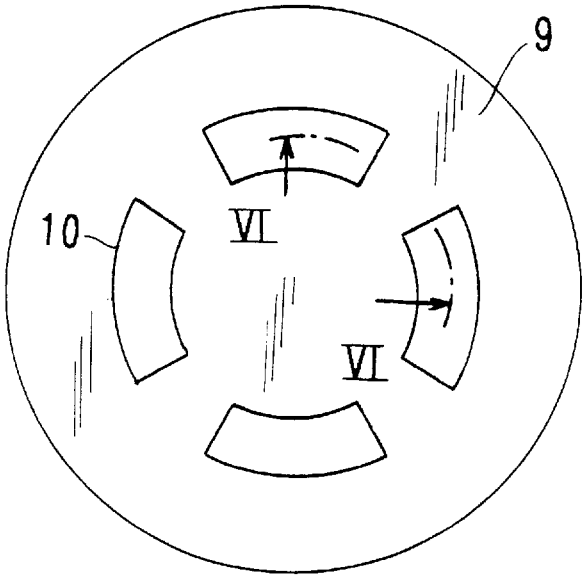
FIG. 5 is a plan view of a coupling spur gear with four pockets.
Figure 6:
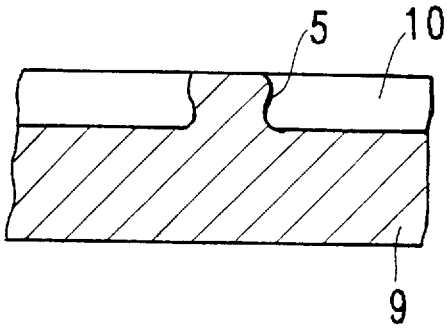
FIG. 6 shows the development of a partial section taken in the peripheral direction on line VI—VI of FIG. 5.

FIG. 5 is a plan view of a coupling member for a shifting coupling of a motor cycle gear box of approximately full size. The coupling member 9 is approximately in the form of a disc, which comprises four arcuate pockets 10 extending in the peripheral direction, in which the claws of a counterpart engage when producing a driving connection. The lateral contact surfaces 5 of the pockets are relieved in the same manner as the contact surfaces of the claws (not shown).

We claim:

1. A method of precision forging of teeth members each having a side contact surface of a material for transmission of power in cooperation with a counterpart, the method comprising the steps of:

(a) initially forging teeth members each with a top joined to side surfaces at respective side edges of said top, a portion of the top being formed at a desired final height, at least one of said side edges having a predetermined overmeasurement extending above said final height;

(b) cold-sizing said side edges with free deformation of the side surfaces to form at least one diverging side contact surface for said teeth members, said at least one diverging side contact surface being for transmission of power and not extending beyond said final height;

said tooth being able to mesh with other teeth members on said counterpart.

2. The method of claim 1 wherein said side edges converge towards one another, said teeth being progressively narrowed in a direction away from said tops.

3. A method as in claim 1, wherein step (b) the side surfaces are unsupported by a die.

4. A method of precision forging of claws for a claw coupling member, said claws having side contact surfaces of a material for transmission of torque in cooperation with a counterpart, comprising the steps of:

rough-forging the claws to produce side contact surfaces and top faces, the top faces each being adjacent to side contact surfaces with a predetermined overmeasure at least in a marginal region adjoining at least one common edge between said top face and said side contact surfaces;

cold-sizing the claws with free deformation of the contact surfaces without support of a die by applying a sizing stroke on top of the top faces to produce said claws with at least one oblique side contact surface for transmission of torque.

5. A method of precision forging a disc of a claw coupling, said disc having a side contact surface of a material for transmission of torque in cooperation with a claw, comprising the steps of:

forming a pocket into a flat surface of a disc, said pocket to receive therein a claw of a claw coupling, said pocket having side contact surfaces joining said flat disc surface at respective common side edges with a predetermined overmeasure of said flat disc surface at least in a marginal region adjoining at least one common edge between said flat disc surface and said side contact surfaces;

cold-sizing said side contact surfaces with free deformation of the contact surfaces to form in said pocket at least one diverging side contact surface for transmission of torque, said side contact surfaces not extending beyond said flat surface of said disc.

6. A method as in claim 5, wherein said contact surfaces are cold-sized without support of a die.

7. A method of precision forging of claws for a claw coupling member, said claws having side contact surfaces of a material for transmission of torque in cooperation with a counterpart, comprising the steps of:

rough-forging the claws to produce side contact surfaces and top faces, the top faces each being adjacent to side contact surfaces with a predetermined overmeasure at least in a marginal region adjoining at least one common edge between said top face and said side contact surfaces;

supporting the claws by a die solely between die faces extending at right angles to the contact surfaces;

cold-sizing the claws with free deformation of the contact surfaces by applying a sizing stroke on top of the top faces to produce said claws each with at least one oblique side contact surface for transmission of torque.

8. A method as in claim 7, wherein said contact surfaces are cold-sized without support of a die.

* * * * *